US007967142B2

(12) United States Patent
Barbalho

(10) Patent No.: US 7,967,142 B2
(45) Date of Patent: Jun. 28, 2011

(54) NESTABLE CRATE

(75) Inventor: Daniel Barbalho, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 165 days.

(21) Appl. No.: 12/323,810

(22) Filed: Nov. 26, 2008

(65) Prior Publication Data

US 2010/0126896 A1 May 27, 2010

(51) Int. Cl.
*B65D 21/00* (2006.01)
*B65D 85/62* (2006.01)

(52) U.S. Cl. ..... 206/507; 206/505; 206/519

(58) Field of Classification Search ..... 206/505, 206/507, 519

See application file for complete search history.

(56) References Cited

U.S. PATENT DOCUMENTS

| | | | | |
|---|---|---|---|---|
| 3,420,402 | A | 1/1969 | Frater et al. | |
| 3,481,507 | A | 12/1969 | Sanders | |
| 3,773,213 | A | 11/1973 | Fredrick | |
| 4,011,948 | A | 3/1977 | Rehrig et al. | |
| D254,424 | S | 3/1980 | Fredrick | |
| D257,478 | S | 11/1980 | Carroll et al. | |
| D271,438 | S | 11/1983 | Miller | |
| 2008/0116100 | A1 * | 5/2008 | Hassell et al. | 206/507 |

* cited by examiner

*Primary Examiner* — Harry A Grosso
(74) *Attorney, Agent, or Firm* — Carlson, Gaskey & Olds

(57) ABSTRACT

A nestable crate provides increased protection to the goods stored inside the crate. Panel portions connect the base to an upper band on each of the walls, while slats are oriented and positioned to provide stack/nest functionality. In an aligned orientation, a pair of crates will stack on one another. With one crate rotated one-hundred-eighty degrees relative to the other, the crates will nest with one another.

28 Claims, 8 Drawing Sheets

NESTABLE CRATE

BACKGROUND OF THE INVENTION

The present invention relates generally to a container, which in one orientation is nestable inside a similar container, and in another orientation stacks on top of the similar container. The container is useful, for example, for shipping cartons of eggs.

Containers, such as egg crates, that are nestable with one another in one orientation and stackable on one another in another orientation, are known. One particular egg crate includes a base wall and an upper band around the periphery of the container. A plurality of vertical slats extend from the upper band to the base. These slats are spaced and arranged such that the slats of one container will fit between the slats of another container in one orientation to provide nesting when the containers are empty. By rotating one container one-hundred-eighty degrees, the slats of the container will interfere and rest on the slats of the lower container, thus providing the ability to stack the containers without damaging goods (such as eggs or egg cartons) stored in the lower container. The container also includes a middle band connecting the slats to one another at a point between the upper band and the base, in order to increase the strength and stability of the slats.

When oriented similarly to a similar crate on which the crate is stacked, the slats of the upper crate rest on the slates of the lower crate. When one crate is rotated one-hundred-eighty degrees relative to the other, the crates nest to reduce storage space. When nested, the middle band of an upper crate rests on the upper band of the lower crate.

SUMMARY OF THE INVENTION

The nestable crate according to one embodiment of the present invention provides increased protection to the goods stored inside the crate. Panel portions are provided on each of the walls to protect the goods more than the slats alone. The crate is still compatible (i.e. can nest and stack) with the known crate.

These and other features of the application can be best understood from the following specification and drawings, the following of which is a brief description.

DETAILED DESCRIPTION OF THE PREFERRED EMBODIMENT

Figure 1:
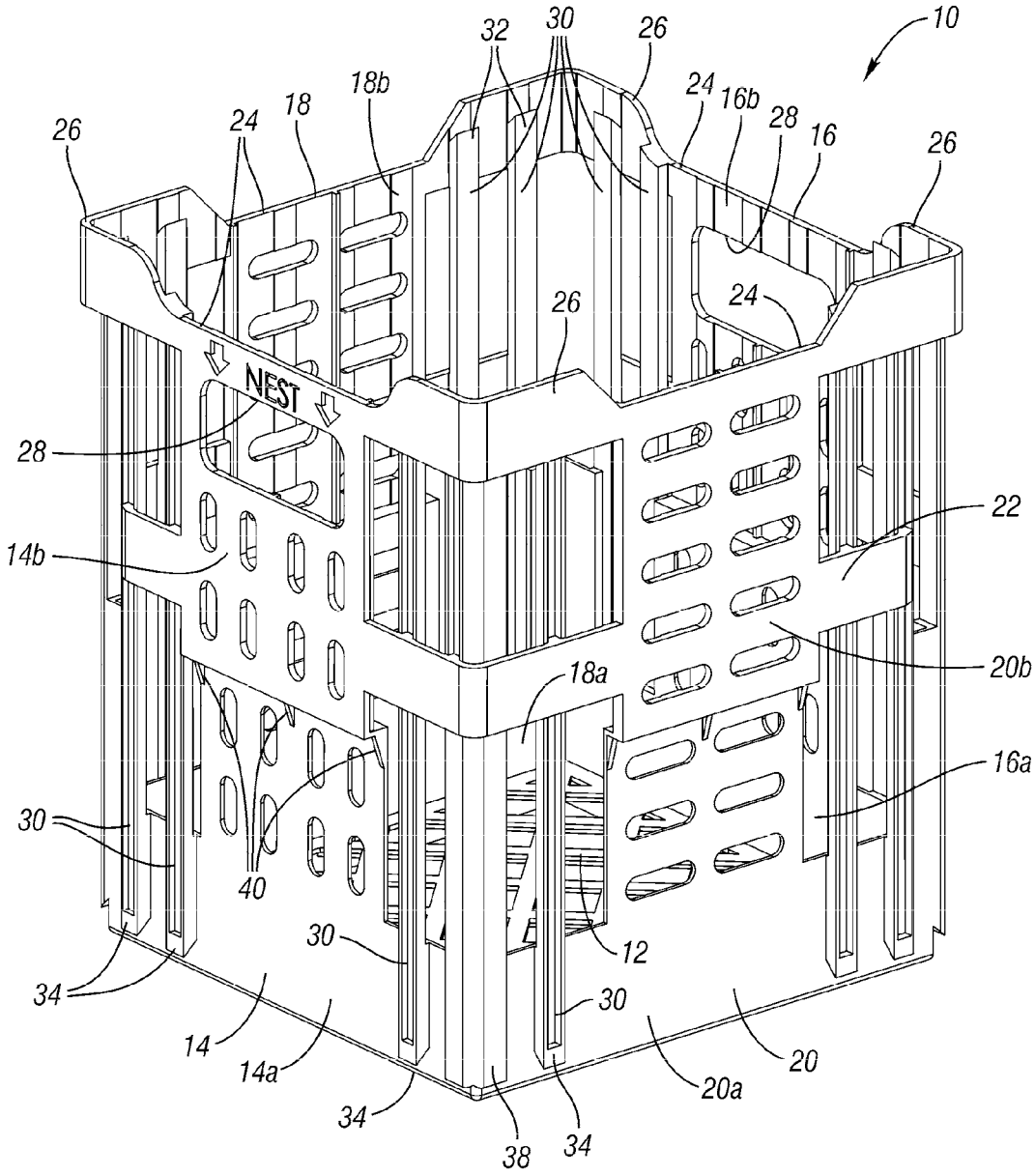
FIG. 1 is a perspective view of a crate according to one embodiment of the present invention.

A crate 10 according to one embodiment of the present invention is shown in FIG. 1. The crate 10 includes a base 12, end walls 14, 16 and side walls 18, 20. Each of the walls 14, 16, 18, 20 includes a lower panel portion 14A, 16A, 18A, 20A, respectively and an upper panel portion 14B, 16B, 18B, 20B respectively. On each wall, the upper panel portion is offset outwardly from the lower panel portion.

A middle band 22 extends around the periphery of the crate 10, connecting the upper panel portions 14B, 16B, 18B, 20B. An upper band 26 at the upper most edge of the crate 10 extends around the entire periphery of the crate 10. The upper band 26 includes a recess 24 in its upper most edge aligned with each wall 14, 16, 18, 20. As a visual and tactile indicator of orientation, the recesses 24 on the end walls 14, 16 may have curved edges, while the recesses 24 on the side walls 18, 20 may have straight, angled edges (or vice versa, or some other visual and/or tactile distinction). Handle openings 28 are formed through the upper panel portions 14B, 16B of the end walls 14, 16.

A plurality of vertical slats 30 are spaced about the periphery of the crate 10 and extend from the exterior side of the lower panel portions 14A, 16A, 18A, 20A then along the interior side of the middle band 22 and the upper band 26. The slats 30 include upper ends 32 that are tapered toward the interior and lower ends 34 tapered toward the exterior of the crate 10.

The upper and lower panel portions may include openings as shown to decrease weight and increase ventilation, but are more closed than the slats. In particular, the panel portions extend horizontally as well as vertically, and thus provide more protection than the slats alone, as in the known crate. As a visual indicator of orientation of the crate 10, the upper panel portions 14B, 16B and the lower panel portions 14A, 16A on the end walls 14, 16 may have vertically elongated openings, while the upper panel portions 18B, 20B and the lower panel portions 18A, 20A on the side walls 18, 20 may have horizontally elongated openings (or vice versa, or some other visible distinction).

Corner supports 38 join the end wall 14 to the side wall 20 and the end wall 16 to the side wall 18 from the lower panel portions to the middle band 22. Gussets 40 optionally connect the lower panel portions 14A, 16A, 18A, 20A to the upper panel portions 14B, 16B, 18B, 20B.

Figure 2:
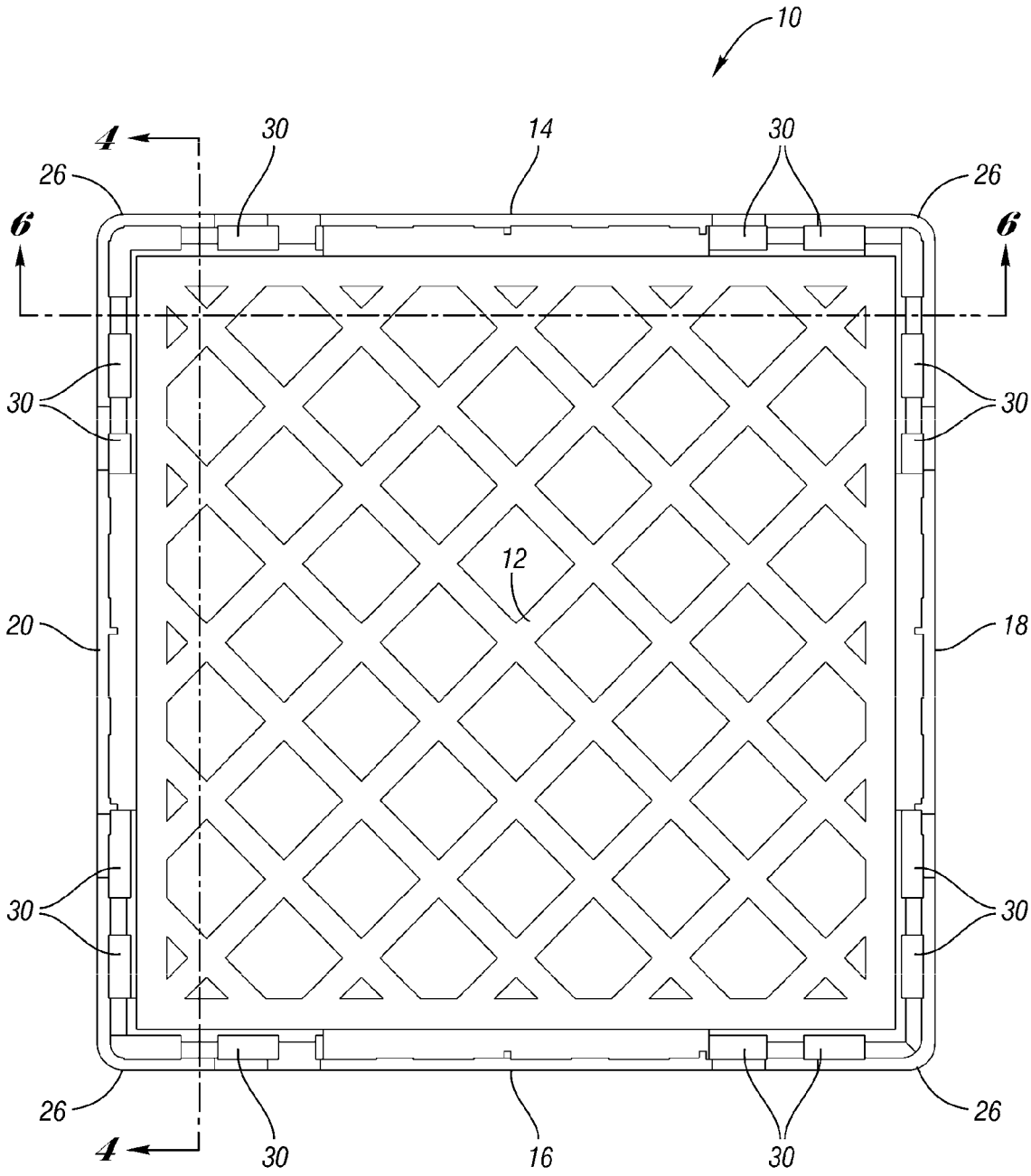
FIG. 2 is a top view of the crate of FIG. 1.

FIG. 2 is a top view of the crate 10 of FIG. 1. As shown, the slats 30 are spaced and oriented to provide the nesting and stacking functions described below.

Figure 3:
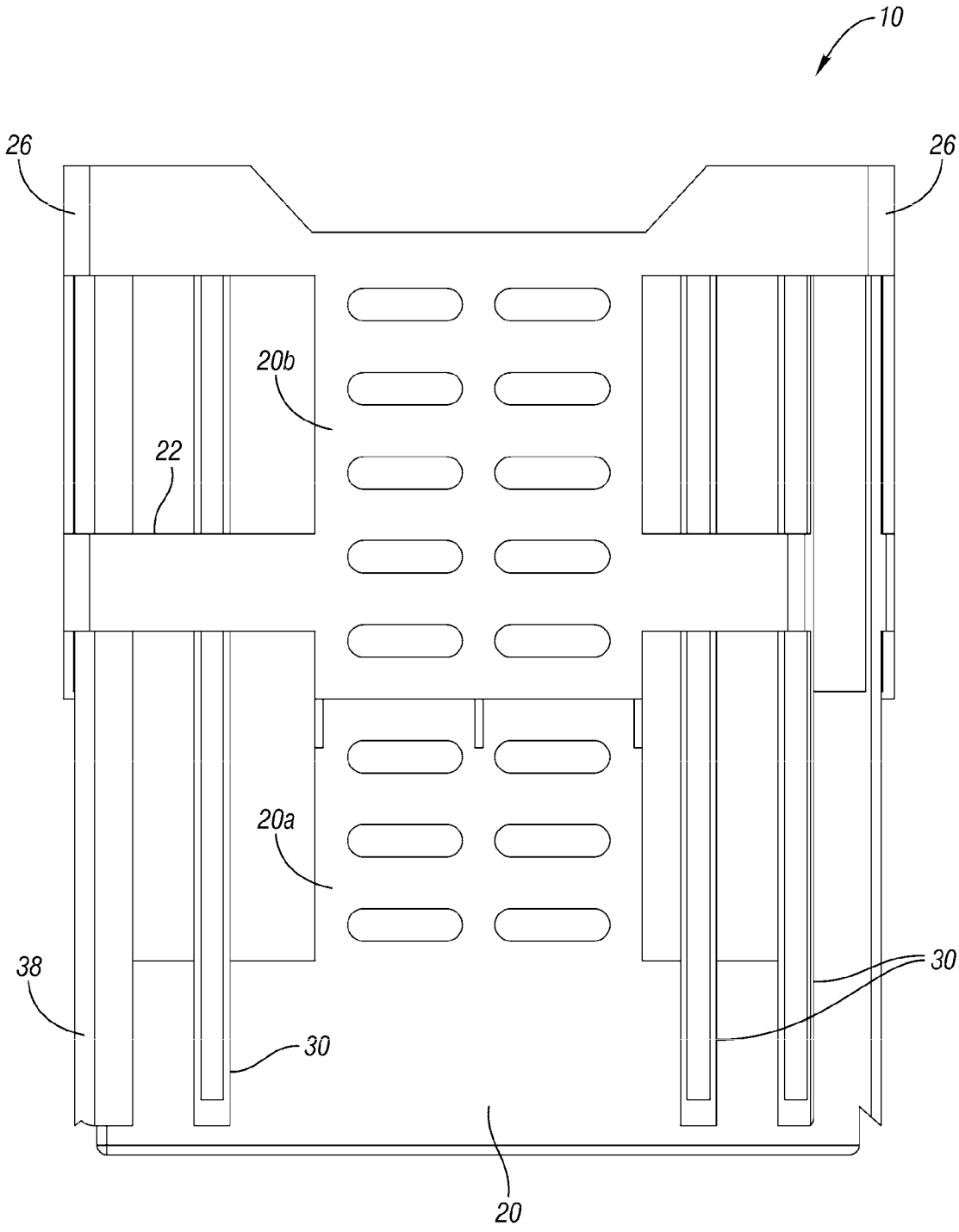
FIG. 3 is a side view of the crate of FIG. 1.

FIG. 3 is a side view of the crate 10 of FIG. 1.

Figure 4:
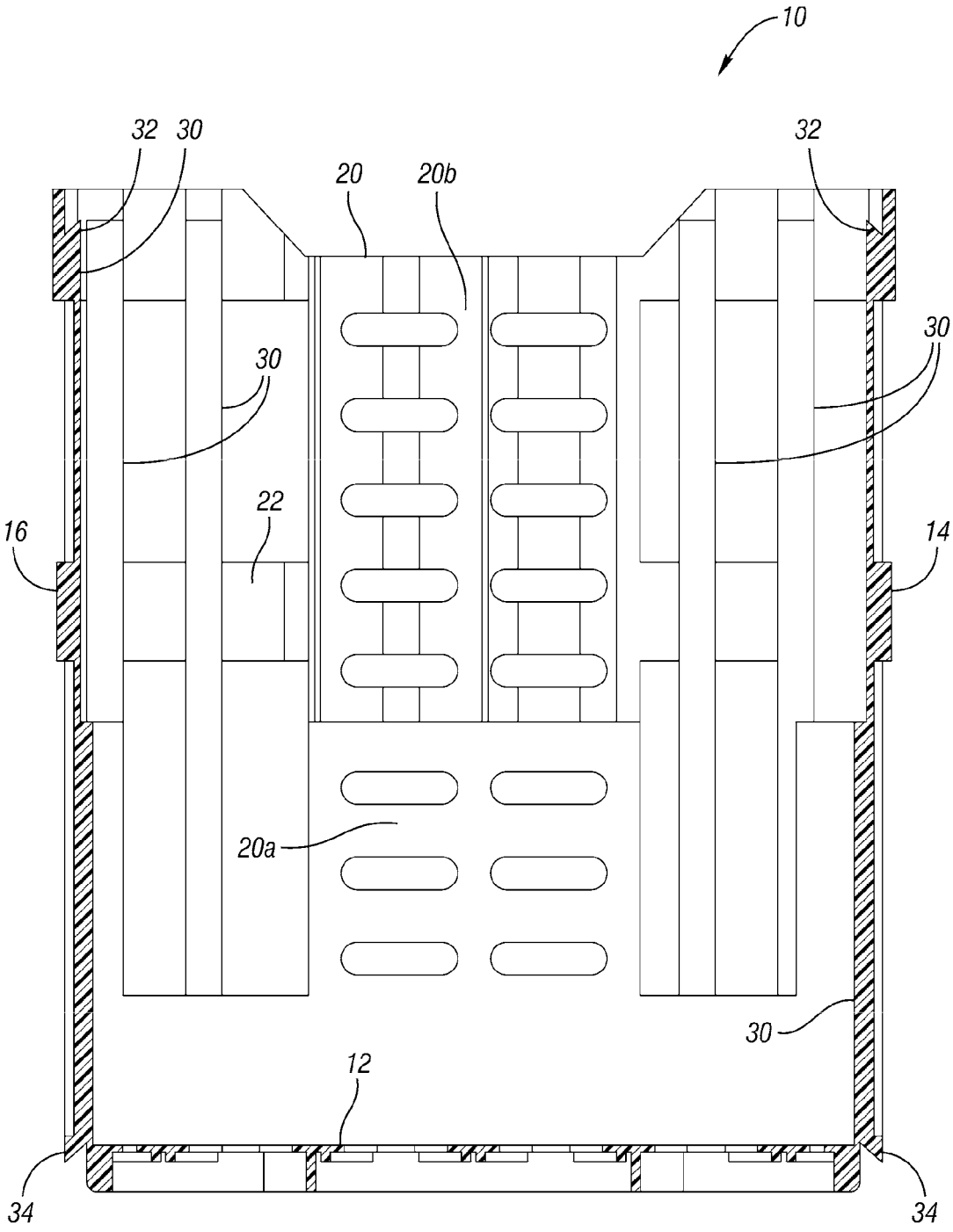
FIG. 4 is a section view taken along line 4-4 of FIG. 2.

FIG. 4 is a section view taken along line 4-4 of FIG. 2. As can be seen in FIG. 4, the upper ends 32 of the slats 30 are aligned with and complementary in shape to the lower ends 34 of the slats 30. Therefore, when one crate 10 is stacked on a similar crate in a similar orientation, the slats 30 align and the lower ends 34 interlock with the upper ends 32 of the slats 30 to provide a stable stack.

Figure 5:
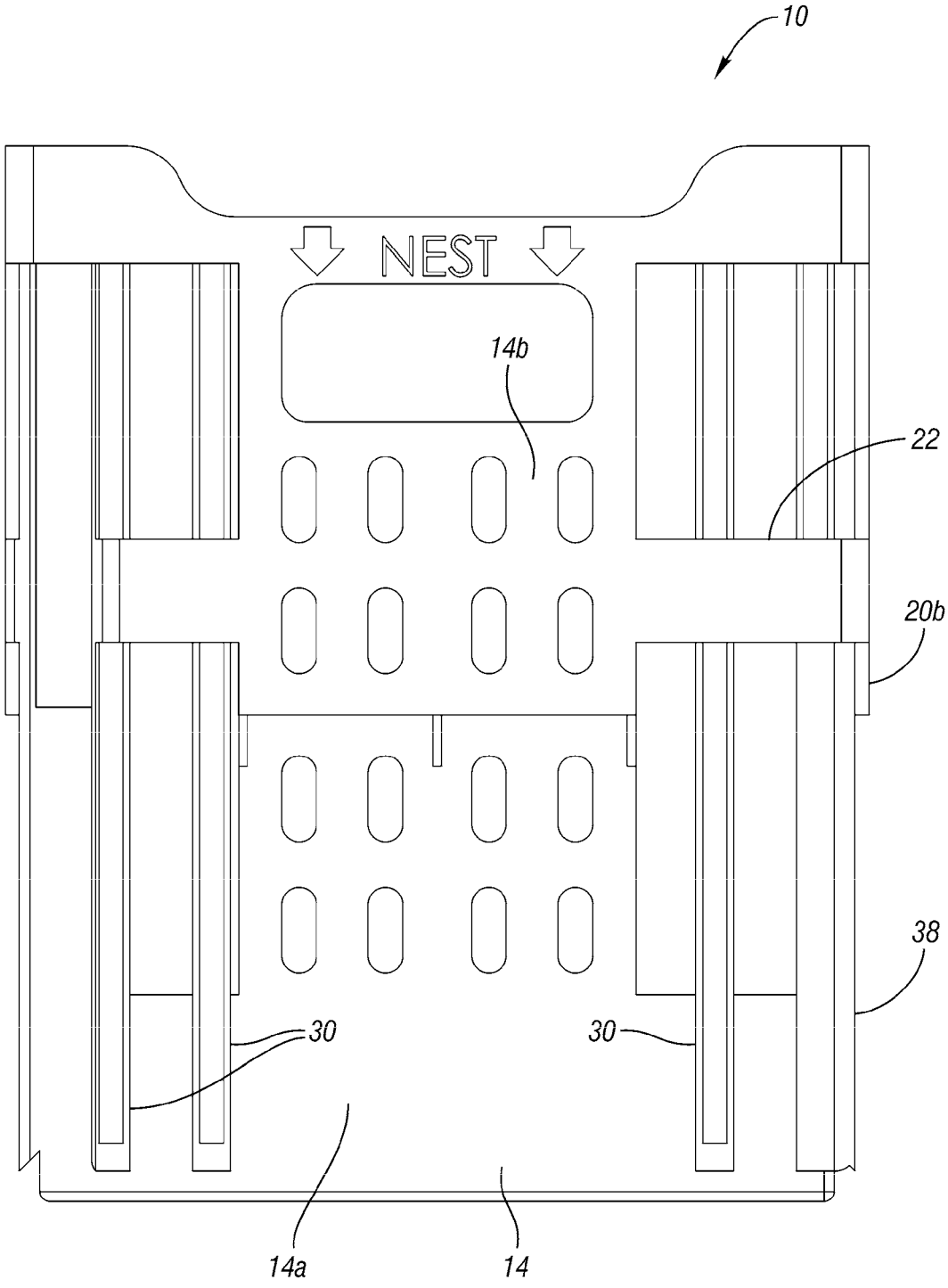
FIG. 5 is a front view of the crate of FIG. 1.

FIG. 5 is an end view of the crate 10.

Figure 6:
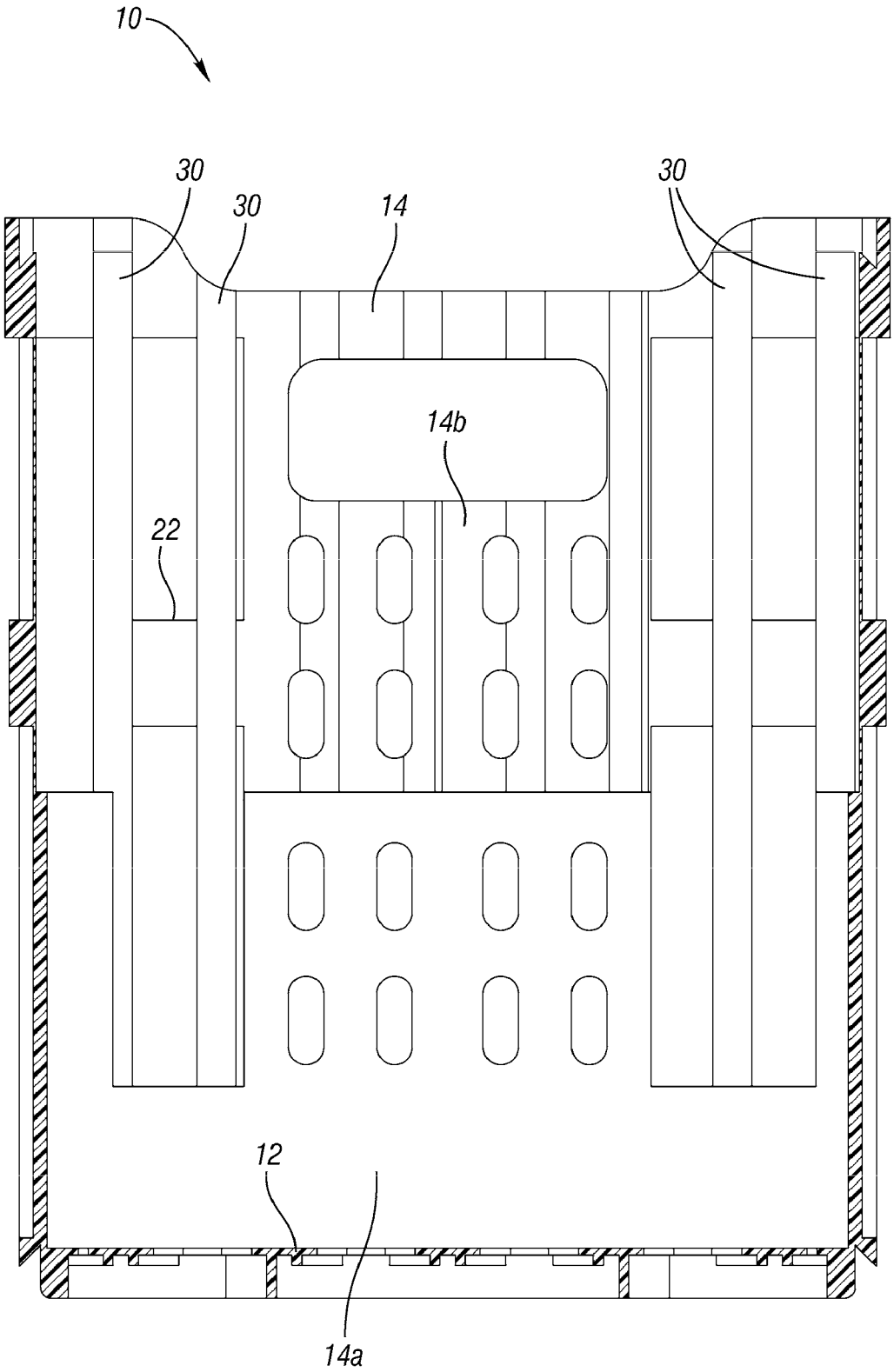
FIG. 6 is a section view taken along line 6-6 of FIG. 2.

FIG. 6 is a section view taken along line 6-6 of FIG. 2.

Figure 7:
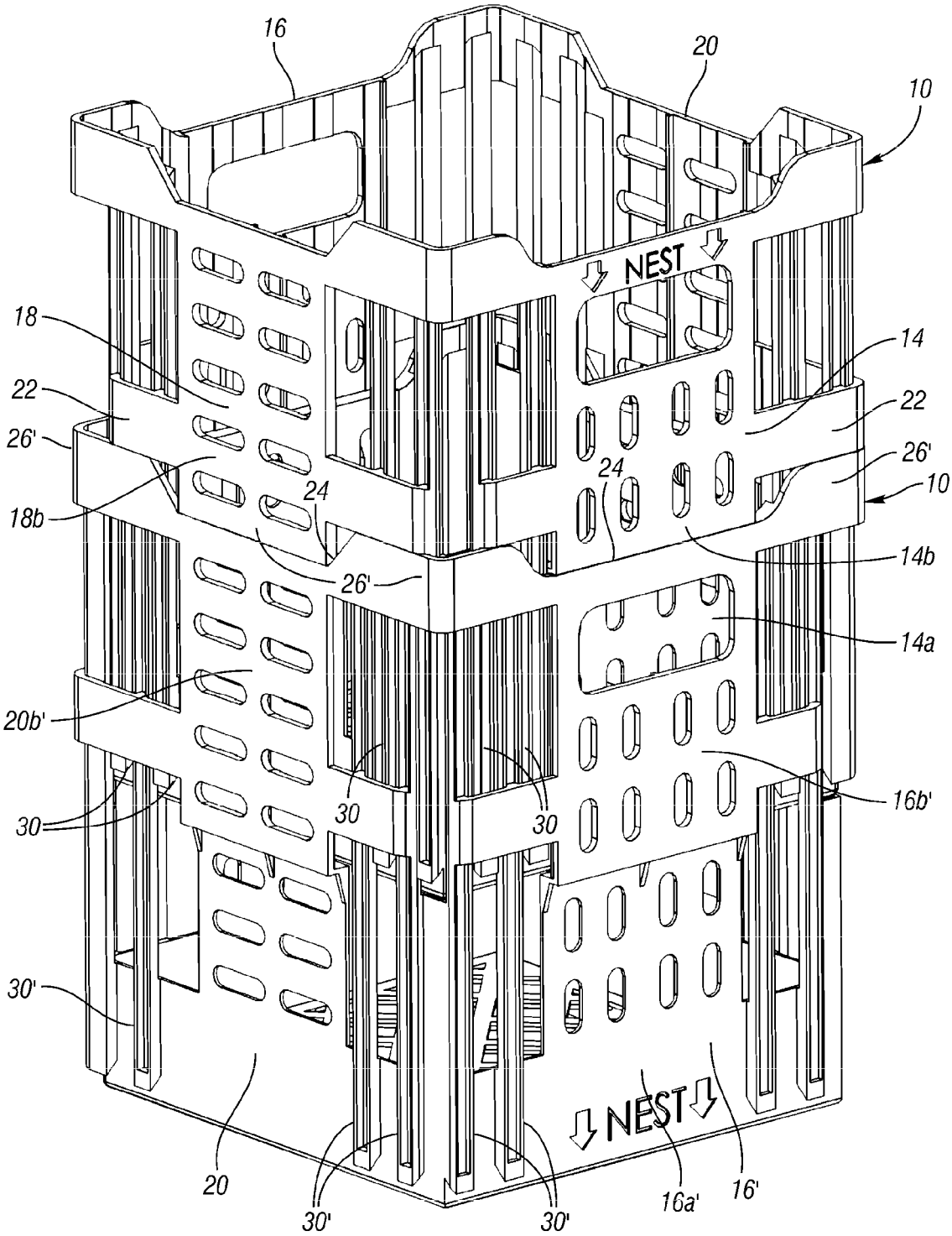
FIG. 7 is a perspective view of the crate of FIG. 1 nested in a similar crate.

FIG. 7 illustrates the crate 10 nested in a similar crate 10'. As shown, when the upper crate 10 is rotated one-hundred-eighty degrees relative to the lower crate 10', the upper crate 10 is partially received within the interior of the lower crate 10'. In particular, the lower panel portions 14A, 16A, 18A, 20A are received between the upper panel portions 14B', 16B', 18B', 20B' of the lower crate 10'. The upper panel portions of the upper crate 10 rest on the upper panel portions of the lower crate 10' within the recesses 24 on the upper edge of the upper band 26'. The middle band 22 of the upper crate 10 also rests on the upper band 26' of the lower crate 10'.

Figure 8:
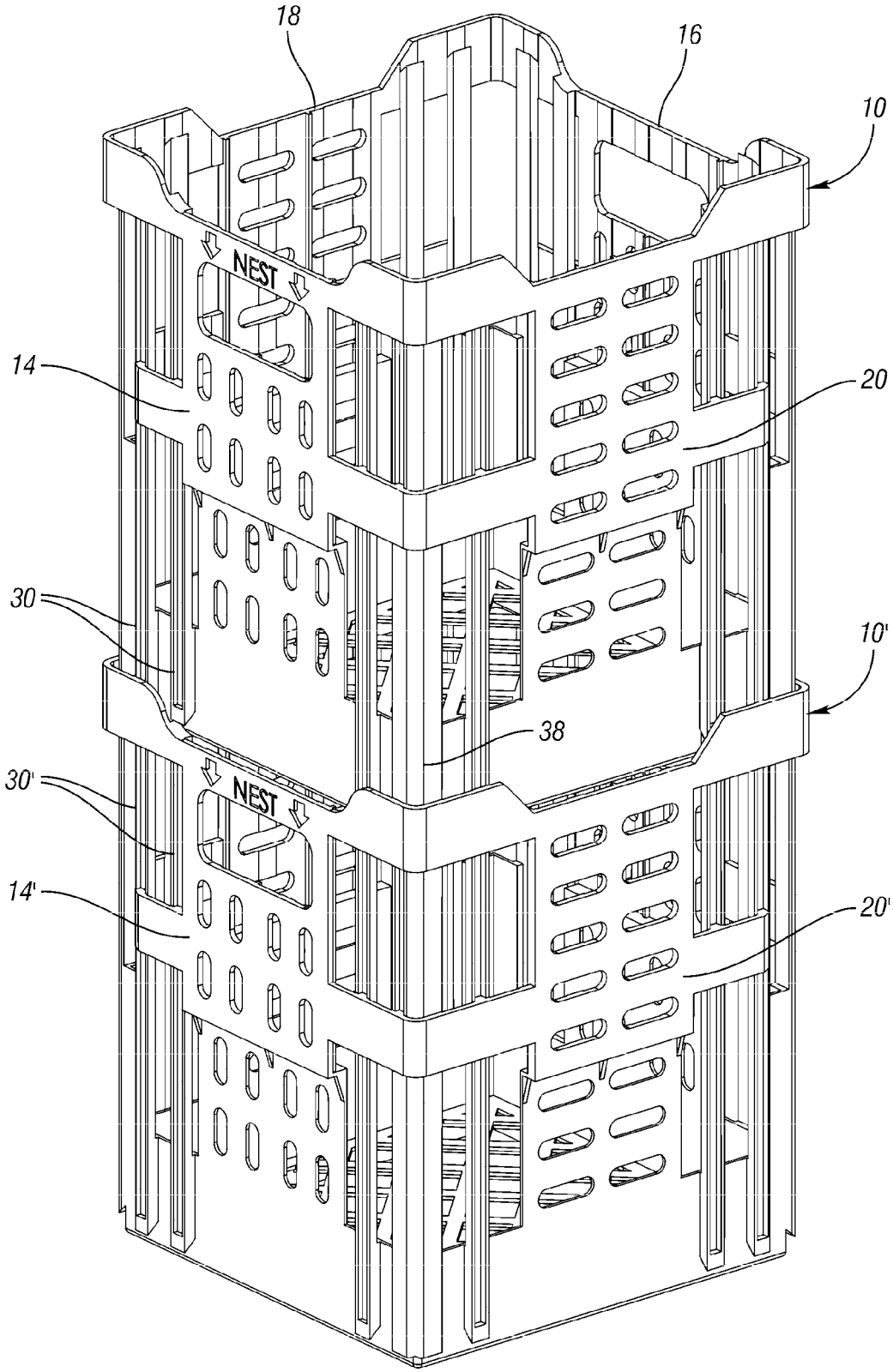
FIG. 8 illustrates the crates of FIG. 7 in a stacked orientation.

FIG. 8 illustrates the crates 10, 10' in the stacked orientation. As shown, when the crates 10, 10' are in the same orientation, i.e. with an end wall 14 oriented over an end wall 14', the slats 30 of the upper crate 10 interlock with and stack on the slats 30' of the lower crate 10'.

The example crate 10 shown is integrally molded as a single piece of plastic, such as polypropylene, polyethylene or other suitable material, via an injection molding process or other suitable process.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A crate comprising:

a base;

a plurality of walls extending upwardly from the base, the plurality of walls including a first wall, the first wall including an upper panel portion offset outwardly from a lower panel portion;

an upper band connecting the plurality of walls along an uppermost edge of the crate, a plurality of vertical slats extending from a lower portion of the crate to the upper band, such that the crate will stack on the slats of a similar crate in one relative orientation and will nest in the similar crate in a second orientation one-hundred-eighty degrees from the one orientation; and the upper band including an uppermost edge having a recess aligned with the upper panel portion, such that the upper panel portion of the crate would be received in the recess of the upper band of the similar crate when the crate is nested in the similar crate.

2. The crate of claim 1 wherein the upper panel portion includes a plurality of openings therethrough.

3. The crate of claim 1 further including at least one gusset connecting the upper panel portion to the lower panel portion.

4. The crate of claim 1 wherein the crate is integrally molded as a single piece of plastic material.

5. The crate of claim 1 wherein the plurality of walls includes four walls and wherein each of the four walls includes the upper panel portion offset outwardly from the lower panel portion.

6. The crate of claim 1 wherein the upper panel portion provides horizontal and vertical connection around a plurality of openings therethrough.

7. The crate of claim 6 further including a handle through the upper panel portion.

8. A crate comprising:

a base;

four walls extending upwardly from the base and integrally molded with the base, each of the four walls including an upper portion offset outwardly from a lower portion, at least one of the upper portions and the lower portions including a panel portion;

an upper band connecting the upper portions of the four walls along an uppermost edge of the crate, an uppermost edge of the upper band having four recesses aligned with the upper portions, such that the upper portions of the crate would be received in the recess of an upper band of a similar crate when the crate is nested in the similar crate; and a plurality of vertical slats extending from a lower portion of the crate to the upper band, such that the crate will stack on the slats of the similar crate in one relative orientation and will nest in the similar crate in a second orientation one-hundred-eighty degrees from the one orientation.

9. The crate of claim 8 wherein at least one of the upper portions includes the panel portion.

10. The crate of claim 8 wherein the upper portions each include an upper panel portion including the panel portion, each upper panel portion including a plurality of openings therethrough.

11. The crate of claim 9 wherein the lower portions each include a lower panel portion, the lower panel portions including a plurality of openings therethrough.

12. The crate of claim 11 further including at least one gusset connecting the upper panel portions to the lower panel portions.

13. The crate of claim 8 further including at least one gusset connecting the upper portions to the lower portions.

14. The crate of claim 8 wherein the panel portion provides horizontal and vertical connection around a plurality of openings therethrough.

15. The crate of claim 8 further including a handle through the panel portion.

16. The crate of claim 8 further including a middle band extending around the exterior of the plurality of slats between the base and the upper band.

17. A crate comprising:

a base;

a plurality of walls extending upwardly from the base, the plurality of walls including a first wall, the first wall including an upper panel portion offset outwardly from a lower panel portion;

an upper band connecting the plurality of walls along an uppermost edge of the crate;

a plurality of vertical slats extending from a lower portion of the crate to the upper band, such that the crate will stack on the slats of a similar crate in one relative orientation and will nest in the similar crate in a second orientation one-hundred-eighty degrees from the one orientation; and a middle band between the base and the upper band, the plurality of vertical slats extending from the lower portion to the middle band to the upper band, wherein the upper panel portion is in-between and spaced from at least a first one of the plurality of slats and at least a second one of the plurality of slats.

18. The crate of claim 17 wherein the middle band extends around an exterior of the plurality of slats.

19. The crate of claim 17 wherein the plurality of slats, including the first one and the second one, extend along an exterior surface of the lower panel portion.

20. A crate comprising:

a base;

a plurality of walls extending upwardly from the base, the plurality of walls including a first wall, the first wall including an upper panel portion offset outwardly from a lower panel portion;

an upper band connecting the plurality of walls along an uppermost edge of the crate, the upper panel portion projecting downwardly from the upper band; and a plurality of vertical slats extending from a lower portion of the crate to the upper band, such that the crate will stack on the slats of a similar crate in one relative orientation and will nest in the similar crate in a second orientation one-hundred-eighty degrees from the one orientation, wherein the upper panel portion is in-between and spaced from at least a first one of the plurality of slats and at least a second one of the plurality of slats.

21. The crate of claim 20 wherein the plurality of slats, including the first one and the second one, extend along an exterior surface of the lower panel portion.

22. The crate of claim 21 further including a middle band between the base and the upper band, the plurality of vertical slats extending from the lower portion to the middle band to the upper band, wherein the middle band extends around an exterior of the plurality of slats.

23. A crate comprising:

a base;

a plurality of walls extending upwardly from the base, the plurality of walls including a first wall, the first wall including an upper panel portion offset outwardly from a lower panel portion;

an upper band connecting the plurality of walls along an uppermost edge of the crate;

a plurality of vertical slats extending from a lower portion of the crate to the upper band, such that the crate will stack on the slats of a similar crate in one relative orientation and will nest in the similar crate in a second orientation one-hundred-eighty degrees from the one orientation;

a middle band between the base and the upper band, the plurality of vertical slats extending from the lower portion to the middle band to the upper band; and a corner support extending from the lower portion to the middle band to the upper band in a corner of the crate, a first vertical slat of the plurality of vertical slats between the corner support and the upper panel portion, the first vertical slat extending freely from the middle band to the upper band.

24. The crate of claim 23 wherein the middle band extends around an exterior of the plurality of slats.

25. The crate of claim 23 wherein the upper panel portion is in-between the first vertical slat and a second vertical slat.

26. The crate of claim 25 wherein the plurality of slats, including the first vertical slat and the second vertical slat, extend along an exterior surface of the lower panel portion.

27. A crate comprising:

a base;

a plurality of walls extending upwardly from the base, the plurality of walls including a first wall, the first wall including an upper panel portion offset outwardly from a lower panel portion;

an upper band connecting the plurality of walls along an uppermost edge of the crate, the upper panel portion projecting downwardly from the upper band;

a plurality of vertical slats extending from a lower portion of the crate to the upper band, such that the crate will stack on the slats of a similar crate in one relative orientation and will nest in the similar crate in a second orientation one-hundred-eighty degrees from the one orientation, wherein the upper panel portion is in-between at least a first one of the plurality of slats and at least a second one of the plurality of slats; and a middle band between the base and the upper band, the plurality of vertical slats extending from the lower portion to the middle band to the upper band, wherein the middle band extends around an exterior of the plurality of slats, wherein the upper band, the upper panel portion and the middle band are parallel to one another and generally co-planar, wherein the upper panel portion extends down below the middle band.

28. The crate of claim 27 wherein the plurality of slats, including the first one and the second one, extend along an exterior surface of the lower panel portion.

* * * * *